US008779917B1

(12) United States Patent
White

(10) Patent No.: US 8,779,917 B1
(45) Date of Patent: Jul. 15, 2014

(54) WEATHER NOTIFICATIONS TO COMMUNICATION DEVICES

(75) Inventor: Joseph White, Meridian, MS (US)

(73) Assignee: AT&T Intellectual Property, I, L.P., Atlanta, GA (US)

( * ) Notice: Subject to any disclaimer, the term of this patent is extended or adjusted under 35 U.S.C. 154(b) by 756 days.

(21) Appl. No.: 11/620,913

(22) Filed: Jan. 8, 2007

(51) Int. Cl.
*G08B 1/08* (2006.01)

(52) U.S. Cl.
USPC ..... 340/539.11; 340/601; 340/539.28; 340/7.48; 379/37; 702/3

(58) Field of Classification Search
USPC ..... 340/601, 539.11, 539.26, 539.28, 905, 340/7.48, 602; 379/37; 702/3; 455/414.2–414.3
See application file for complete search history.

(56) References Cited

U.S. PATENT DOCUMENTS

| | | | | |
|---|---|---|---|---|
| 6,509,833 | B2 * | 1/2003 | Tate | 340/539.1 |
| 6,553,100 | B1 * | 4/2003 | Chen et al. | 379/37 |
| 6,654,689 | B1 * | 11/2003 | Kelly et al. | 702/3 |
| 6,710,715 | B2 | 3/2004 | Deeds | |
| 6,728,522 | B1 | 4/2004 | Marrah et al. | |
| 6,850,604 | B2 | 2/2005 | Cannell et al. | |
| 6,919,821 | B1 * | 7/2005 | Smith | 340/905 |
| 6,973,336 | B2 | 12/2005 | Heie | |
| 7,053,780 | B1 | 5/2006 | Straub et al. | |
| 7,631,047 | B1 * | 12/2009 | Adamczyk et al. | 709/207 |
| 7,664,233 | B1 * | 2/2010 | Kirchmeier et al. | 379/37 |
| 2003/0006912 | A1 * | 1/2003 | Brescia | 340/990 |
| 2003/0023690 | A1 * | 1/2003 | Lohtia | 709/206 |
| 2004/0043760 | A1 * | 3/2004 | Rosenfeld et al. | 455/414.3 |
| 2004/0172454 | A1 * | 9/2004 | Appelman et al. | 709/206 |
| 2008/0063154 | A1 * | 3/2008 | Tamari et al. | 379/88.13 |

OTHER PUBLICATIONS

Brown, B., "Wireless Internet-Based Remote Control Using a Pager Interface," Newsletter, IEEE Consultants' Network of Connecticut, Sep. 1, 2001, 6 pages.
EMCOM National Emergency Alert Notification System, available at http://www.comdinet.com/emcom/index1.html, copyright 1998-2003, pp. 1 -7.
"National Weather Service, NOAA Weather Radio (NWR) Transmitters," update #4.43, available at http://205.156.54.206/nwr/nwrsame.htm, Jul. 13, 1999, pp. 1-30.
"NOAA Weather Radio: A Lifesaver for the Cost of a Pair of Shoes," available at http://govinfo.library.unt.edu/accessamerica/docs/noaaradio.html, May 10, 1999, pp. 1-3.
"Selecting a Weather Radio Receiver," available at http://www.pioneer.com/media/weather_radio/radio_choose.htm, copyright 1996-2004, pp. 1-2.

(Continued)

*Primary Examiner* — Nabil Syed
*Assistant Examiner* — Nay Tun
(74) *Attorney, Agent, or Firm* — Baker & Hostetler LLP

(57) ABSTRACT

Methods, apparatus, and computer readable media for providing real-time weather notifications to at least one communication device across various networks are described. Methods disclose receiving meteorological information or weather conditions corresponding to an affected geographical area. Methods disclose accessing a database for information concerning the at least one communication device. The affected geographical area identified in the national weather notification service is evaluated in relationship to a real-time location of the at least one communication device. A notification of weather conditions is generated. This notification of weather conditions is transmitted to at least one communication device.

18 Claims, 5 Drawing Sheets

(56) References Cited

OTHER PUBLICATIONS

"Weather Alert 2000," available at http://www.weathermatrix.net/merchandise/wa2k.shtml, copyright 1996-2003, pp. 1-2.
Weigel, R., "Review: Weather Alert 2000," available at http://www.techtv.com/products/consumerelectronics/story/0.23008.3358065.00.html, Nov. 2, 2001, pp. 1-2.
"Winbond Launches Industry's First Single-Chip Text-To-Speech Solution," available at http://www.winbond-usa.com/news/pressrel/11-01-2001.shtml, Nov. 1, 2001, pp. 1-2.
"WX-1000 Weather Receiver with SAME Technology," available at http://www.catauto.com/wx1000.html, copyright 2003-2004, pp. 1-5.

* cited by examiner

WEATHER NOTIFICATIONS TO COMMUNICATION DEVICES

TECHNICAL FIELD

The subject matter relates generally to weather notifications and more specifically, to methods for providing weather notifications to at least one communication device across various networks.

BACKGROUND

Services such as the National Weather Service (NWS) and National Weather Radio (NWR) issue metrological information, severe weather warnings, watches, and conditions. Individuals may receive this information in real-time to have sufficient time to evacuate, to take cover in shelters, buildings, and/or to protect property. Real-time means current or actual time during which something occurs, such as severe weather conditions. However, in some instances, individuals may not be able to receive real-time information, access NWS to view a television, or access NWR to listen to a radio. In addition, individuals may not be able to constantly monitor real-time weather conditions to be aware of approaching dangerous and/or hazardous weather conditions. Often, weather conditions may change dramatically or suddenly, or weather forecast predictions may be inaccurate. Weather conditions may be transmitted to a communication device.

There are many forms of communication devices. One form is a landline telephone system. Landline telephone systems are commonly employed in office environments, education facilities, hospitals, government agencies, public facilities, households, and the like because of lower operating costs. Another form of communication devices is a wireless communication system. Wireless communication has grown in popularity, such that approximately seventy percent of the households in the United States own a mobile communication device, while some households no longer employ a landline phone. Wireless communication devices may allow users the convenience of receiving calls in various locations and during suitable hours.

Owning a mobile communication device may present difficulties when receiving real-time weather information. As individuals travel or commute with mobile communication devices, warning systems may not provide notifications for a current, an existing, or an approaching location. Rather, warning systems may relay real-time weather information for a particular and specific location associated with the mobile communication device. For example, a subscriber's information for the particular and specific location may be a home address, while the subscriber is traveling with the mobile communication device in another state, county, or region.

SUMMARY

Methods for providing real-time weather notifications to at least one communication device across various networks are described. Methods disclose receiving meteorological information or weather conditions corresponding to an affected geographical area. Methods disclose accessing a database for information concerning the at least one communication device. The affected geographical area identified in the national weather notification service is evaluated in relationship to a real-time location of the at least one communication device. A notification of weather conditions is generated. This notification of weather conditions is transmitted to at least one communication device.

Other systems, methods, and/or computer program products according to embodiments will be or become apparent to one with skill in the art upon review of the following drawings and detailed description. It is intended that all such additional systems, methods, and/or computer program products be included within this description, be within the scope of this description and be protected by the accompanying claims.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Various exemplary operating environments, systems, methods, and related apparatuses provide weather conditions notifications to communication devices across different types of networks. These exemplary operating environments, methods, and apparatuses enable at least one communication device to interact within a variety of networks to subscribe to telecommunication services providing weather warning notifications to the communication devices.

Figure 1A:
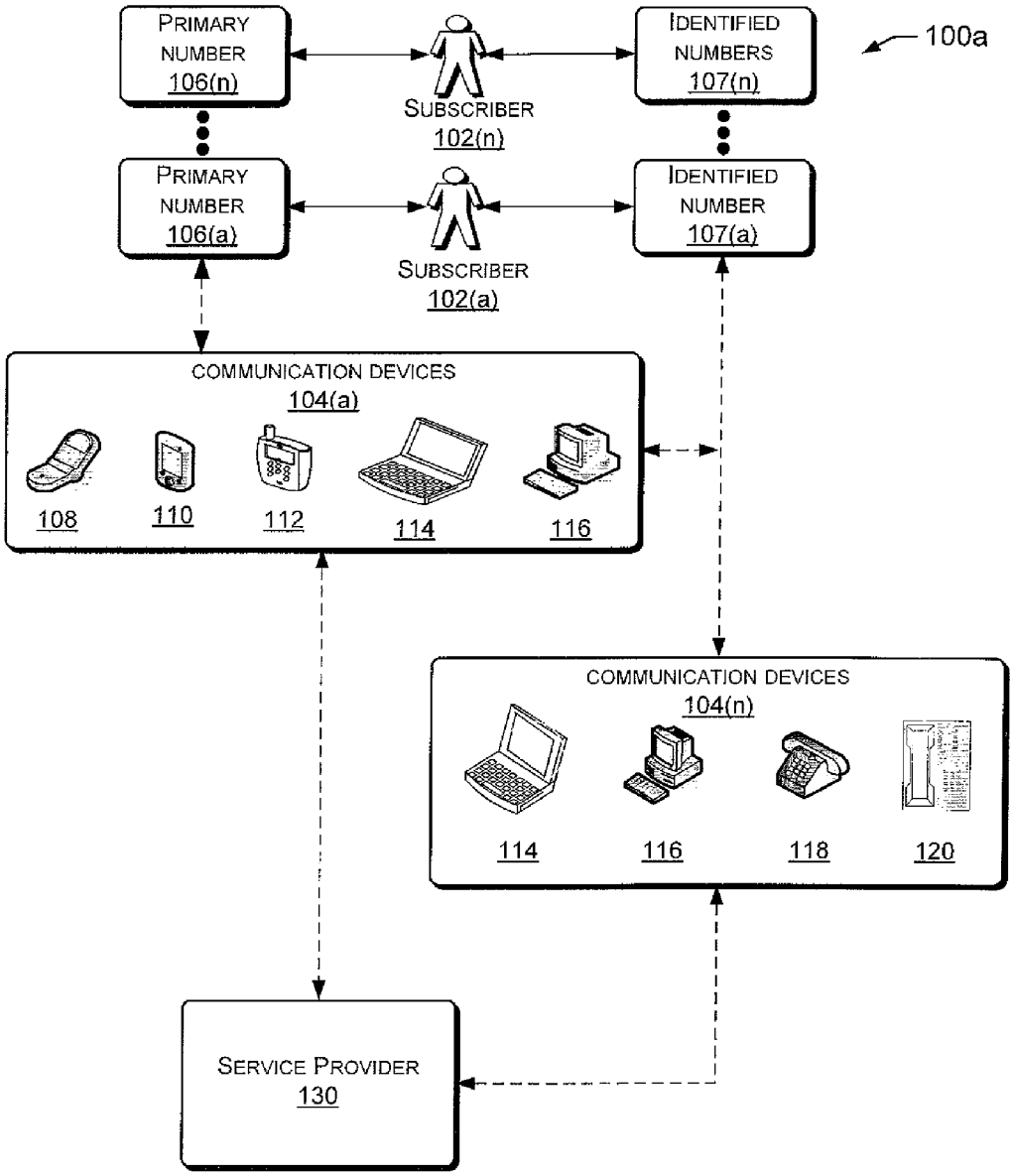
FIG. 1*a* is a block diagram of an exemplary operating environment depicting different examples of communication devices for use in providing weather notifications.

FIG. 1*a* illustrates an exemplary operating environment 100*a* for providing a notification of weather conditions to communication devices. The terms "subscriber" 102(*a*) . . . 102(*n*), "user", and "consumer" may be used interchangeably to describe a person or an entity using a communication device and/or a person or an entity subscribing to a consumer telecommunication services. Other terms are also used interchangeably with user and subscriber, such as "customer" or "account holder".

Subscribers 102(*a*) . . . 102(*n*) may use communication devices 104(*a*) . . . 104(*n*) as a form of communication. The term "communication device" may mean a device allowing an individual to interact with an electronic information system or the like. The operating environment 100*a* may support one or more of the communication devices 104(*a*) . . . 104(*n*), which may transmit or receive data, text, video, audio, information, communication, and the like. A subscriber, such as the subscriber 102(*a*), may use wireless communication as a main form of communication, while another subscriber, such as the subscriber 102(*n*), may use landline communication as the main form of communication.

The communication devices 104(*a*) . . . 104(*n*) employed as a main form of communication have a primary number 106(*a*) . . . 106(*n*) associated directly with the devices. The term "number" may be used interchangeably to describe the communication devices 104(*a*) . . . 104(*n*) receiving transmission of data, text, video, audio, information, and the like. The terms "number", "phone number", and "network address"

may be used interchangeably to identify an address associated with a communication device, such as the communication device 104(*a*). Thus, "number" may include phone numbers, network addresses, email addresses, and the like. For example, the primary phone number 106(*a*) provides direct access to the wireless communication device 104(*a*), which is used as the subscriber's 102(*a*) main form of communication device.

At least one of the communication devices 104(*a*) . . . 104(*n*), as shown, may be purchased or leased by the subscriber from a service provider 130. For a second device or additional communication devices 104(*a*) . . . 104(*n*) owned or leased, there may be one or more identified numbers 107(*a*) . . . 107(*n*) associated with the second or additional communication devices. The numbers 107(*a*) . . . 107(*n*) may be included on an identified list or a call list. The identified list may be associated with the subscriber's subscription account with the service provider 130. In exemplary embodiments, the subscribers may wish to receive weather notifications on the primary number 106(*a*) of the first communication device 104(*a*) and the identified number 107(*a*) of the second communication device 104(*n*). In other embodiments, these numbers may be on the call list to send weather notifications to multiple numbers. These numbers 106(*a*) . . . 106(*n*) and 107(*a*) . . . 107(*n*) and devices 104(*a*) . . . 104(*n*) are not shown in any particular order, but are shown for illustrative purposes only.

As shown in FIG. 1*a*, the wireless communication device 104(*a*) may include a cellular telephone 108, a wireless-enabled personal digital assistant (PDA) 110, a smart phone 112, a laptop computer 114, a desktop computer 116, or other similar mobile devices and/or associated with a wireless network. The landline communication device 104(*n*) may take several forms, including the laptop computer 114, the desktop computer 116, a landline phone 118 located at a house, an apartment, a business, or a landline business phone 120 located in a business enterprise or a shared network, or other similar landline devices associated with a circuit type network.

For illustrative purposes, the laptop computer 114 and the desktop computer 116 are shown as two forms of communication, wireless and landline. These devices may be associated with the subscriber 102(*a*) or with other individuals, businesses, education facilities, government associations, hospitals, and the like. For example, the subscriber 102(*a*) may access the laptop computer 114 or the desktop computer 116 to access his or her voice mails or e-mails while away from home or office. By way of illustration, the subscriber 102(*a*) may access his or her own desktop computer 116 remotely, without being in or near the office.

As previously mentioned, owning or leasing two or more of the communication devices 104(*a*) . . . 104(*n*), the subscribers 102(*a*) . . . (*n*) may be associated respectively with one or more primary numbers 106(*a*) . . . 106(*n*) and one or more identified numbers 107(*a*) . . . 107(*n*). In exemplary embodiments, the subscriber 102(*a*) may own the cell phone 108, the laptop computer 114, and the landline phone at home 118. The subscriber 102(*a*) may wish to receive notification of weather conditions on any number of communication devices 104(*a*) (e.g., one, two, three, and/or more). If the subscriber 102(*a*) receives notifications on, for example, all three devices, the notifications may be sent to the primary number 106(*a*) for the cell phone 108 and the identified network addresses/numbers 107(*a*) . . . 107(*n*) for the laptop computer 114 and landline phone at home 118.

For illustrative purposes, dashed lines illustrate the primary and the identified numbers 106(*a*) . . . 106(*n*) and 107(*a*) . . . 107(*n*) leading to and from the communication devices 104(*a*) . . . 104(*n*). In exemplary embodiments, the subscriber 102(*a*) may have the primary number 106(*a*) associated with the wireless communication device 104(*a*) and the identified numbers 107(*a*) associated with wireless communication devices 104(*a*) and/or landline communication devices 104(*n*).

In other embodiments, the subscriber 102(*n*) may have the primary number 106(*n*) associated with the landline communication device 104(*n*) and the identified numbers 107(*n*) associated with the wireless communication devices 104(*a*) and/or landline communication devices. In exemplary embodiments, the subscriber 102(*a*) may wish to have two or more primary numbers 106(*a*) . . . 106(*n*) associated with communication devices 104(*a*) . . . 104(*n*) as the main forms of communication and one or more identified numbers 107(*a*) . . . 107(*n*) associated with the other communication devices.

The subscriber 102(*a*) may subscribe to telecommunications services offered by the service provider 130. These telecommunications services may include features such as weather warning notifications, abbreviated dialing to members of a specified user group, call forwarding, call waiting, three-way conferencing, distinctive ring functions, or other types of calling features. Services, such as the weather warning notifications, may occur upon the subscriber subscribing with the service provider 130 of telecommunication services. Thus, the service provider 130 may load the primary numbers 106(*a*) . . . 106(*n*) and the identified numbers 107(*a*) . . . 107(*n*) provided by the subscribers 102(*a*) . . . 102(*n*) into a call list for providing weather notifications to these multiple numbers.

The primary numbers 106(*a*) . . . 106(*n*) and the one or more identified numbers 107(*a*) . . . 107(*n*) for the communication devices 104(*a*) . . . 104(*n*) may receive distinctive ring functions, tones, audible notifications, vibrations, and/or visual indications to distinguish weather warning notifications from other types of communication. Furthermore, the weather warning notifications with distinctive ring functions, tones, audible notifications and/or visual indications may also be transmitted to the communication device 104(*a*), while the subscriber 102(*a*) is using the communication device. These features may be provided by the service provider 130.

By way of illustration, the primary number 106(*a*) associated with the cellular phone 108 may play alarm or warning tones to indicate the calls or messages are weather warning notifications and real-time information. In exemplary embodiments, the primary number 106(*a*) may receive weather notifications by an audible tone, visual indication, vibrations, text message and the like, while the subscriber 102(*a*) is using the cellular phone 108.

Other exemplary embodiments may include ring functions and tones that may identify the communication is a weather notification, if a unique ring tone is assigned to or associated with a caller of the national weather notification service or with a number of the national weather notification service. Thus, the subscriber 102(*a*) may set up the caller identification information. These ring functions and/or tones may be available from the service provider 130, purchased through a website, downloaded for free, or accessible from a server.

Furthermore, the primary numbers 106(*a*) . . . 106(*n*) and the identified numbers 107(*a*) . . . 107(*n*) may receive 'simultaneous notifications' from the service provider 130. The term "simultaneous notifications" may include ring tones, audible notifications, or visual indications of weather warnings that are directed at approximately the same time to the primary numbers 106(*a*) . . . 106(*n*) and/or the identified numbers 107(*a*) . . . 107(*n*). The term "approximately" indicates that the warnings may arrive at two or more communication devices 104(*a*) . . . 104(*n*) at slightly different times, owing to device capabilities, network conditions, geographical factors affecting the different devices, and the like. The term "weather warning notification" may describe calls or messages, including video, voice, multimedia, email, text, and data. In embodiments, these weather warnings are provided to one or more primary numbers 106(*a*) . . . 106(*n*) and/or to one or more identified numbers 107(*a*) . . . 107(*n*), which, in turn, are assigned to two or more different communication devices 104(*a*) . . . 104(*n*).

In exemplary embodiments, the subscriber 102(*a*) may receive weather warnings directed to the identified number 107(*a*), and the communication may "simultaneously notify" on the first communication device 104(*a*), such as cellular phone 108 and the second communication device 104(*n*), such as the landline phone at home 118. Using the telecommunication features, the subscriber 102(*a*) may specify the times and days when the weather warning notifications are routed, by sending appropriate instructions to the service provider 130. The subscriber 102(*a*) may also specify any distinctive ring functions or tones with which incoming calls are announced. Furthermore, in exemplary embodiments, the subscriber 102(*a*) may "turn off" the weather notification services to the landline communication devices 104(*n*), if traveling away from the landline area, such as for business or pleasure.

In exemplary embodiments, the subscriber 102(*a*) may establish the priority order of calls, such as the weather warning notification rings first on the primary number 106(*a*) before ringing on the identified number 107(*a*). These weather warning calls, as directed to the primary and identified numbers 106(*a*) . . . 106(*n*) and 107(*a*) . . . 107(*n*), may occur within a few seconds of one another, and may be considered 'simultaneous'. In another example, the priority order of calls may establish ringing on the cellular phone 108 first, the landline business phone 120 second, and the landline home phone 118 third.

Figure 1B:
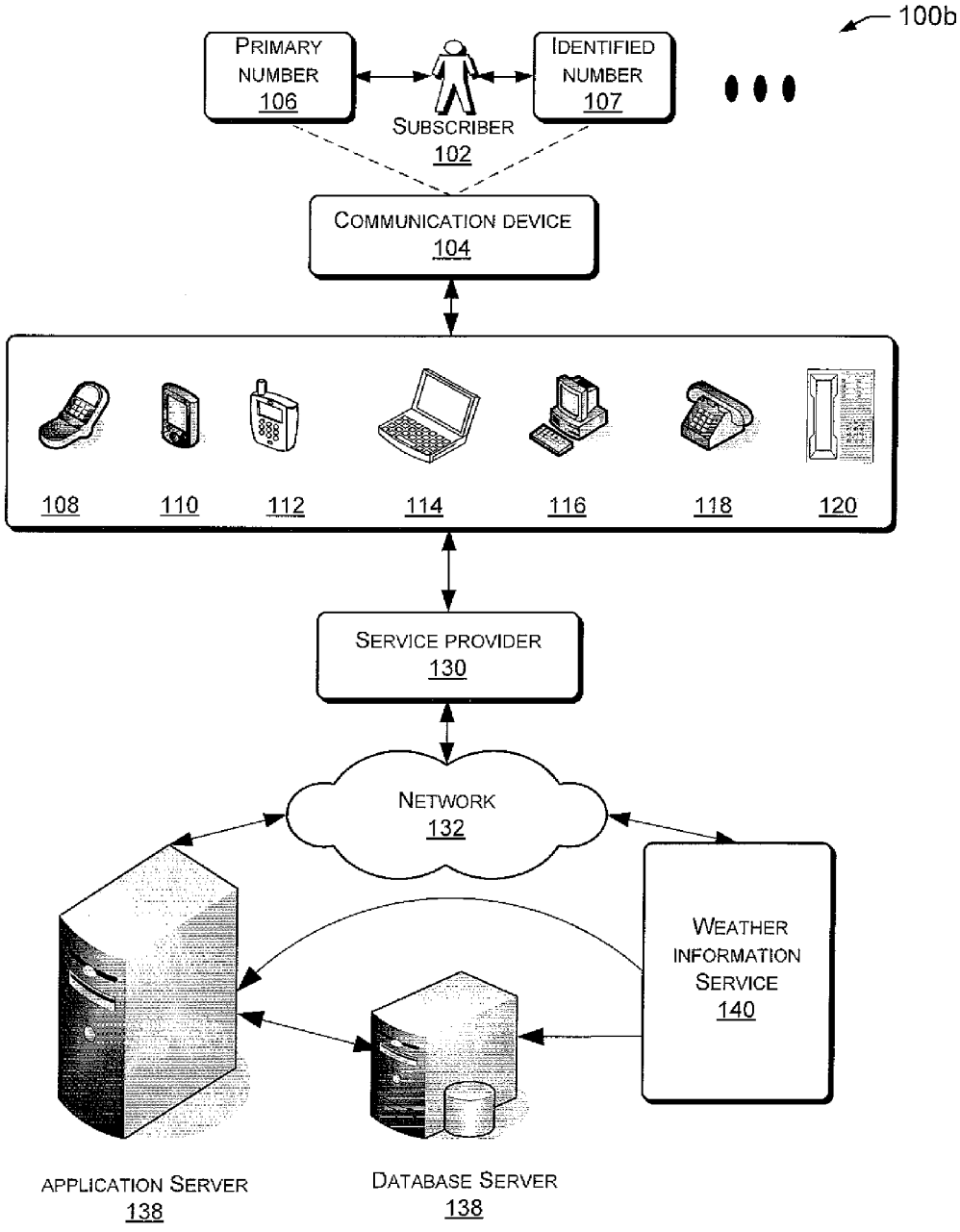
FIG. 1*b* is a block diagram of an exemplary operating environment for providing weather notifications to at least one communication device, shown in FIG. 1*a*.

Turning to FIG. 1*b*, this figure illustrates an exemplary operating environment 100*b* for providing weather notifications to at least one communication device, shown generally at 104 in FIG. 1*b*. The service provider 130 may enable the mobile communication devices 104 to access a network 132, such as a packet-switched network and/or a circuit-switched network. In some instances, the service provider 130 may enable the subscriber, shown generally at 102 in FIG. 1*b*, to "roam" while using networks provided and maintained by other service providers. Service providers may include telephone service providers, such as interexchange and local exchange carriers including incumbent and/or competitive exchange carriers. Other telecommunication service providers may include Internet telephone service providers (VoIP), wireless telephone service providers (cellular), and the like. By using communication services with various service providers, communication may be integrated seamlessly across different types of networks.

The communication device 104 functions in either unlicensed wireless or licensed cellular technologies, such as unlicensed IEEE 802.11 wireless networking standard. An example of a suitable licensed cellular technology is global system for mobile communications (GSM) or code division multiple access (CDMA). A non-limiting example of the communication device is the cordless WiFi SIP phone. This capability to operate on different frequencies allows the communication device to operate in regions that use different frequencies (e.g., 900 MHz, 1850 MHz, or other frequencies).

To support digital communications, the communication device 104 may operate under schemes such as CDMA, time division multiple access (TDMA), frequency division multiple access (FDMA), advanced mobile phone system (AMPS), general packet radio service (GPRS), and universal mobile telecommunications system (UMTS). The communication device 104 may also be compatible with a second generation (2G) or a third generation (3G) network.

Other networks include but not limited to, interne, GSM/UMTS cellular network, business WiFi LANs, home WiFi LANs, public WiFi hotspots, WiMAX wide area networks, and/or other types of circuit-switched or packet-switched networks. Furthermore, the subscriber 102 may use the mobile communication device 104 at home by accessing a WiFi LAN located in his or her home. The WiFi LAN may enable the subscriber 104 to access a broadband data service, such as Digital Subscriber Line (DSL) service, satellite Internet service, or cable modem service.

The service provider 130 may include a media gateway (MG) that provides interoperability between the packet-switched network and the circuit-switched network. The media gateway converts packet-switched voice/data traffic to circuit switched voice/data traffic, and vice versa. Thus, the MG may provide cross-application user interface for phone, instant messaging, video and file exchange communications.

The communication devices 104 and the service provider 130 may exchange text, voice, data, multimedia, as represented generally by the solid lines with the arrowheads between the devices. The exchange of communication flow may be either unidirectional or bidirectional in nature.

The system at the service provider 130 may provide an application server 136 or other computing device. The service provider 130 may also provide one or more database servers 138 that communicate with the application server 136. Finally, the service provider 130 may communicate with one or more weather information services 140 via the network 132. The application server 136 may generate and send the notifications of weather conditions, track locations of individual communication devices associated with subscribers, as well as providing voice mail, electronic mail, or other services at least to the subscriber 102. Furthermore, in some instances, the application server 136 or other servers may provide calling features such as direct calling, call forwarding, call waiting, distinctive ring functions, tones, or other type of calling features and services.

While FIG. 1*b* shows only one database server 138, information relating to the subscriber 102 and/or the communication devices 104 may be stored in any number of distributed databases and related servers. Additionally, while FIG. 1*b* shows the database server 138 remotely from the application server 136, the database may be at least partially stored locally on the application server. The database hosted on the server 138 may include, but is not limited to, a subscriber's profile, a subscriber's services, a subscriber's name, a subscriber's services to the weather notification service, a subscriber's phone number, a subscriber's network address, a subscriber's home address, a subscriber's work address, geographical locations associated with the subscriber of the communication devices, and the like.

FIG. 1*b* shows one weather information service 140 for ease of illustration only. However, the weather information service 140 may include any number of other national, regional, or local services that may provide weather information. These services, and any related servers, may communicate with the application server 136 and/or the database 138. In exemplary embodiments, the application server 136 may receive the weather information service 140 from service providers, such as the service provider 130, or servers. The service providers 130 and servers may include national, regional, or local weather services, weather stations, national, regional, or local weather radio, a private weather information servers or services, weather information servers or services that are internal to the service provider, and the like.

In exemplary embodiments, the subscriber 102 with the communication device 104 may utilize services and equipment located on premises at a location of the communication device. In another possible implementation, the subscriber 102 of the communication device 104 may utilize services and equipment located on the premises of an entity that provides telecommunication services to the communication device, in an outsourcing arrangement.

Application Server Providing Weather Notifications

Figure 2:
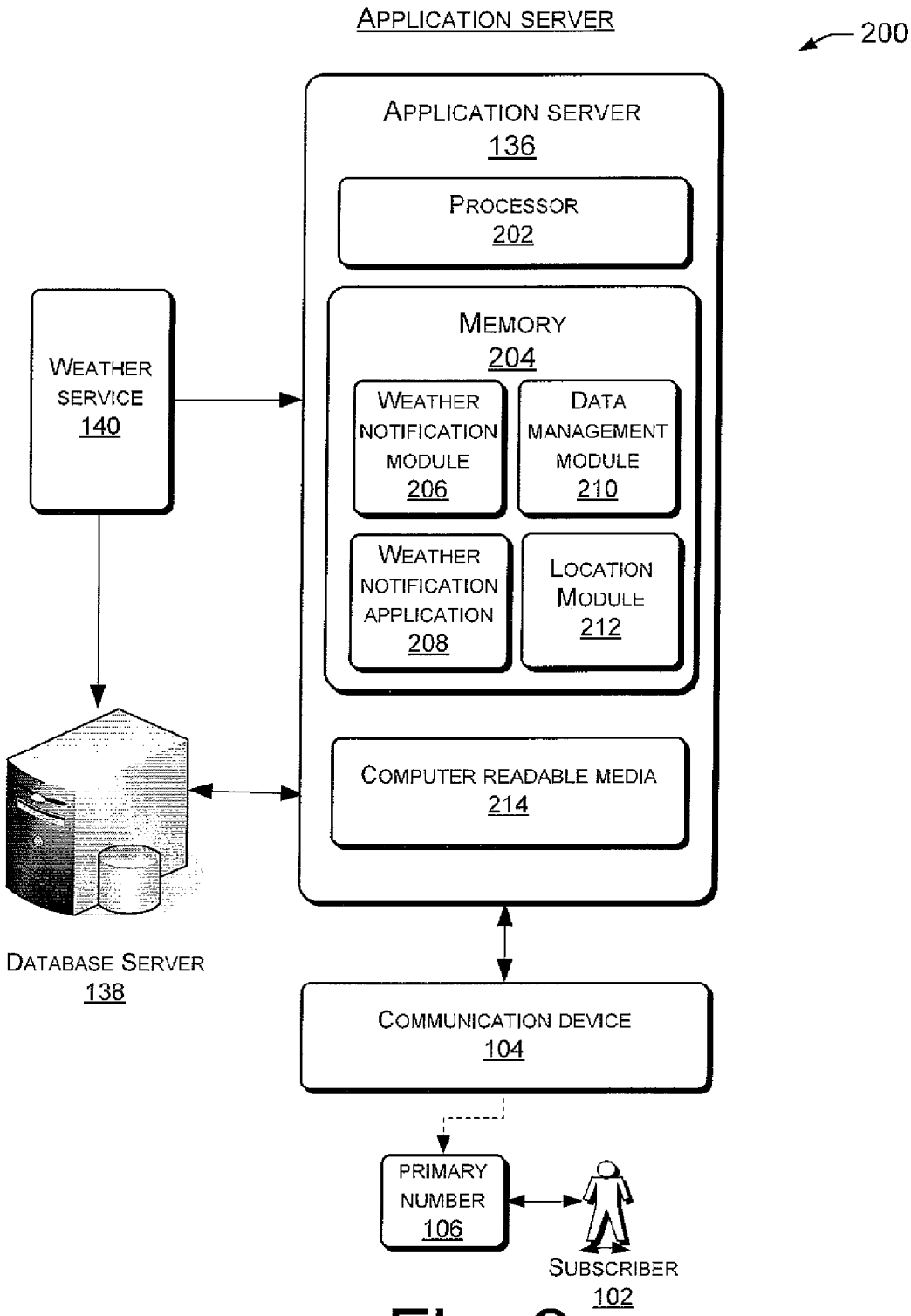
FIG. 2 is a block diagram illustrating an application server layout in providing weather notifications.

FIG. 2 illustrates example components, denoted generally at 200, within the application server 136 for providing weather warning notifications. FIG. 2 illustrates the application server 136 in more detail, as communicating with the database server 138 and the weather information service 140 of FIG. 1. The application server 136 may be configured as any suitable computing device capable of implementing a notification of weather conditions.

In exemplary embodiments, the application server 136 includes at least one processing unit or processor 202 and memory 204. The processing unit 202 may be implemented as appropriate in hardware, software, firmware, or combinations thereof. Software or firmware implementations of the processing unit 202 may include computer- or machine-executable instructions written in any suitable programming language to perform the various functions described herein.

Memory 204 may store programs of instructions that are loadable and executable on the processor 202, as well as data generated during the execution of these programs. The memory 204 may store any number of programs, data objects, other data structures, including an operating system, one or more application programs, other program modules, and program data.

It will be understood that the memory 204 may be implemented as volatile memory that, in turn, may include media such as random access memory (RAM), and non-volatile memory may include read only memory (ROM). Other removable/non-removable, volatile/non-volatile computer storage media, such as a hard disk drive for reading from and writing to a non-removable, non-volatile magnetic media, a magnetic disk drive for reading from and writing to a removable, non-volatile magnetic disk (e.g., a "floppy disk"), and an optical disk drive for reading from and/or writing to a removable, non-volatile optical disk such as a CD-ROM, DVD-ROM, or other optical media may be included. The disk drives and their associated computer-readable media may provide non-volatile storage of computer readable instructions, data structures, program modules, and other data for the communication devices.

Turning to the contents of the memory 204 in more detail, the memory may include a weather notification module 206 that tracks and stores data representing geographical areas affected by adverse weather conditions, based on, for example, notifications from the weather service 140.

According to exemplary embodiments, the weather notification module 206 stores and manages data representing one or more geographical areas affected by, for example, severe weather conditions, hazardous conditions, weather watches, or the like. Additionally, the weather notification module 206 may manage information relating to weather predictions affecting a nation, a region, a county, a city, a town, a phone number within a geographical area, a network address with the geographical area, a zip code, and the like. The weather notification module 206 may communicate with one or more local and/or remote weather service providers, such as the weather information service 140, as well as communicating with the database 138.

The memory 204 may also include a weather notification application 208 for providing notifications of adverse weather conditions to those subscribers who are located within geographic areas affected by such adverse conditions. The weather notification application 208 may interact with the weather service 140 to receive the weather notifications. Additionally, the weather notification application 208 may communicate with the database 138 to retrieve information concerning the subscriber's profile. For example, the weather notification application 208 may extract contact information for subscribers who receive severe weather notifications.

The weather notification application 208 may receive meteorological information or severe weather information from the national weather information service 140 and may provide information to the database 138. The application program 208 accesses the database 138 for information relating to the communication device 104 and to the subscriber 102 of the weather notification service. Furthermore, the weather notification application 208 evaluates the real-time locations of the communication device 104 in relationship to the affected geographical areas from the national weather service.

A data management module 210 manages and stores information related to providing weather notification. This information may include, for example, subscriber profiles, subscriber numbers, subscriber network addresses, weather information, locations of communication devices, affected geographical areas, and the like. The data management module 210 may communicate with one or more local and/or remote databases or services, such as the database 136 and related server 138, the weather service 140, or the like. Furthermore, the data management module 210 may communicate with a location module 212, as now described.

The location module 212 may track current locations of one or more different communication devices. When a given communication device, such as the communication device 104, registers, the location module 212 may identify the location of the given communication device. The location module 212 may communicate with one or more local and/or remote locating servers to locate the device 104. For example, in some instances, the location module 212 may receive information from a global positioning system, a server-aided global positioning system, a position locating service. In other instances, the location module 212 may identify the real-time location of the communication device 104 using one or more signals, cell towers, triangulation methods, or the like.

The location module 212 may interact with the data management module 210 to store information representing the real-time or current location of the device 104, as well as information relating to the subscribers. The location module 212 may search for the subscriber's current network location associated with the communication device 104, storing the information for example, in the application server 136 and the database 138.

The location module 212 may provide updates of the real-time locations of the communication devices 104 as received from the locating servers, methods or signals. Upon notification from the weather information service of severe weather, the location module 212 may search and provide the real-time location of the device 104. In some instances, the location module 212 may conduct this search immediately after receiving the notification, or as soon as practicable afterwards, depending on the severity or urgency of the notification. Thus, the location module 212 assists in locating the communication device 104 relative to geographical areas affected by severe weather and/or hazardous conditions.

According to exemplary embodiments, the weather notification application 208 generates a notification of weather conditions based on a subscriber's profile information in the database 138, the real-time location of the communication device 104 in relationship to the affected geographical area, and a number or a network address for the communication device. The application 208 transmits the notification of weather conditions to at least one communication device 104 if the notification conditions are met.

The application 208 transmits the notifications to the communication device 104, which may include but not limited to, a landline phone, a mobile device, a cellular phone, a Voice over internet protocol phone, a landline phone, a personal digital assistant, or a computer (laptop, desktop, or handheld). The notification of weather conditions sent to the communication device 104 and to a primary number and/or an identified number may include a recording, a text-to-speech, a video, an instant message, an email, a text message, or a voice mail message.

The notification may further include distinctive ring functions, tones, audible notifications, or visual indications associated with the communication device 104, associated with the national weather service caller, and/or associated with the national weather service identification. These distinctive ring functions, tones, audible notifications or visual indications may be provided by the service provider. The notification may be transmitted to the communication device 104 over a circuit-switched network and/or a packet-switched network, such as the network 132. For example, the notification may be sent to the communication device 104, to a primary number, shown generally at 106 in FIG. 2, and to the subscriber 102, as shown.

The application server 136 may communicate with the database 138, the weather information service 140, and/or other devices on the network 132. Communication media typically embodies computer readable instructions, data structures, program modules or other data in a modulated data signal such as a carrier wave or other transport mechanism and includes any information delivery media. The application server 136 includes computer readable media 214. The term computer readable media as used includes both storage media and communication media.

The application server 136 may delete any undelivered notification of weather conditions after an amount of time has passed. For example, a weather notification that has been generated, but has not been sent due to inoperable communication connections, inactive battery, and the like may be deleted. After a certain period of time, the weather conditions are no longer hazardous or dangerous, and a subscriber may wish to have an undelivered notification 'deleted', rather than receive the late notification. In other embodiments, the subscriber may wish to receive the notification of weather conditions, upon operable communication connections.

Database Used in Providing Weather Notifications

Figure 3:
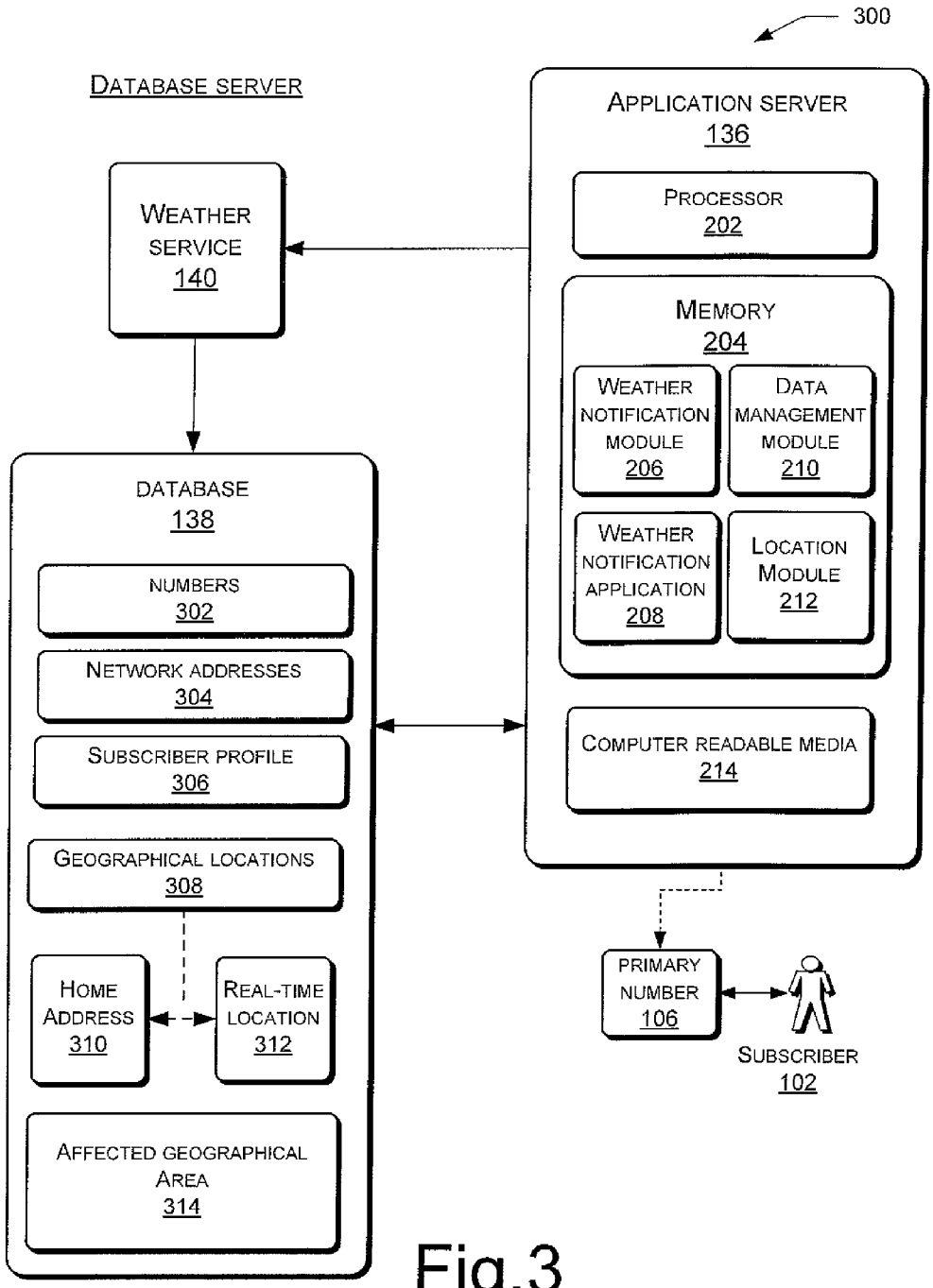
FIG. 3 is a block diagram illustrating a database layout in providing weather notifications.

FIG. 3 illustrates fields and records 300 suitable for implementing a database for providing weather notifications. The database 138 may include, but is not limited to, one or more subscriber phone numbers 302, subscriber network addresses 304, and subscriber profiles or fields 306. The subscriber profiles or fields 306 may include information, such as data indicating a subscriber's telecommunication services, a subscriber's name, a subscriber's services to the weather notification service, a subscriber's work address and the like. The database 138 may also include geographical location fields 308 that store locations associated with the subscriber of the communication devices. The geographical locations fields 308 may include a subscriber's home address 310 for landline systems and a subscriber's real-time location 312 for wireless communication devices. In addition, the database 138 may include fields that store data representing severe weather conditions and the corresponding affected geographical areas 314.

The database 138 may receive, store, and send the information to and from the application server 136. Furthermore, the database 138 may receive and store information from the national weather information service 140. The database 138 may be located remotely from the application server 136 or may be partially stored locally on the application server.

Process for Notification of Weather Conditions

Figure 4:
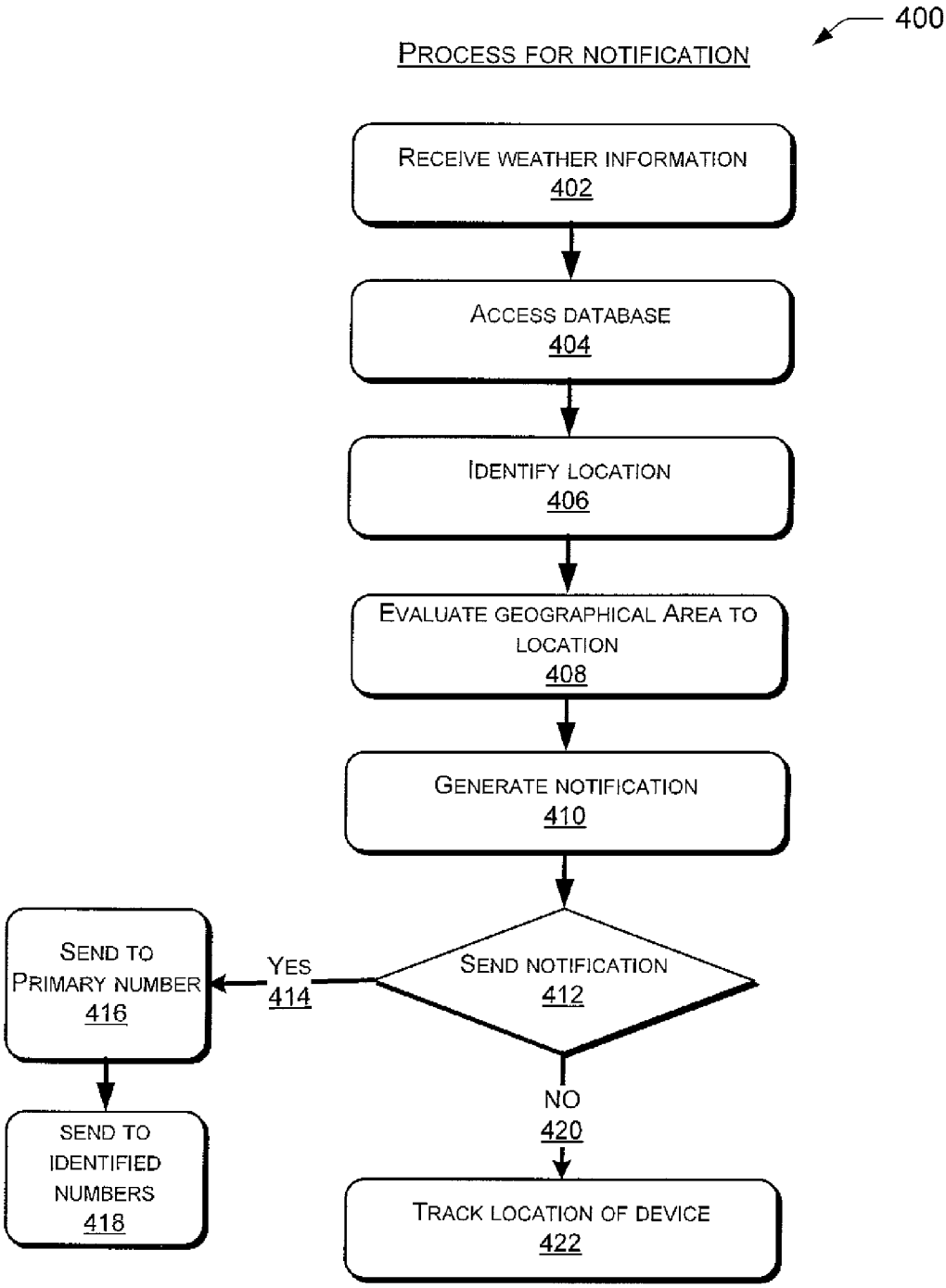
FIG. 4 is a flow diagram of a process for providing weather notifications to one or more mobile communication devices.

FIG. 4 illustrates a process flow 400 for providing a notification of weather conditions to at least one communication device. For ease of understanding, FIG. 4 shows various aspects of the method 400 within separate blocks. However, FIG. 4 shows these blocks in the order presented only for convenience, but not for limitation. Implementations of the processing represented in these blocks may perform this processing in any order, without departing from the scope and spirit of the description.

In addition, implementations of the process flow 400 may combine or further subdivide any number of the described process blocks. Moreover, implementations of the process flow 400 may omit one or more of the described blocks. For convenience only, the process flow 400 is described in connection with certain components shown in FIGS. 2 and 3. However, it is understood that the process flow 400 may be performed with other components without departing from the spirit and scope of the description.

Block 402 represents receiving notifications of severe weather or hazardous conditions, warnings, or watches. By way of illustration, an application server (e.g., 136 in FIG. 1*b*) and/or a database (e.g., 138 in FIG. 1*b*) may receive this notification from a weather information service, such as the weather information service 140. The weather information service 140 is one example, but other services or one or more servers relating to weather information may be connected to the application server 136 and/or the database 138. In exemplary embodiments, the weather information service 140 may receive information from at least one of a national weather service, a weather station, a national weather radio, a private weather information server, an internal weather information server to the service provider, or the like.

In addition, block 402 represents receiving indications of severe weather conditions affecting one or more given geographical areas. The affected geographical areas may be identified by a region, a county, a city, a town, a phone number within a geographical area, a network address within a geographical area, a zip code, and the like. In exemplary embodiments, a weather notification module (e.g., 206) manages and stores information pertaining to, for example, severe weather conditions, hazardous conditions, weather watches, and/or weather predictions affecting these areas. Also, the database 138 may store this information.

Block 404 represents accessing the database 137 for information relating to the at least one communication device. The database 138 may contain information relating to one or more subscribers. This information may include, for example, a subscriber's name, a subscriber's phone number, a subscriber's network address, a subscriber's home address, a subscriber's work address, a subscriber's services with a service provider, and the like.

Block 406 represents identifying a real-time, a current, or an existing location of the communication device. In exemplary embodiments, the application server 136 and/or the database 138 may receive the real-time, the current, or the existing locations of the communication devices from a locating server or a location module, such as the location module 212, of the application server. The locating server or the location module 212 may use location information from a global positioning system, a server-aided global positioning system, a position locating service, a triangulation method, a signal, or a cell tower. In exemplary embodiments, the location module 212 may continually search for the subscriber's real-time network location associated with the at least one communication device. The location module 212 may provide updates by communicating and storing the information in the database 138.

Block 408 represents evaluating the affected geographical areas corresponding to the severe weather conditions in relationship to the real-time locations of the communication device. In exemplary embodiments, the application server 136 determines whether communication devices may be located within a "range" of the affected geographical areas. The term "range" may refer to a number of miles within the affected geographical areas based on weather radar information.

Block 410 represents generating a notification of weather conditions based on a subscriber's profile information in the database 138, the real-time locations of the communication devices in relationship to the affected geographical areas and a number/a network address for the communication devices.

In exemplary embodiments, the subscriber's profile 306 may include instructions for receiving notification of weather conditions based on locations, such as work or home; time of day, such as mornings, or nights only; type of weather conditions, such as snow and thunderstorms only; a particular communication device to notify, such as a cellular phone but not a landline phone; and the like. Block 410 may include monitoring the weather conditions over time to assess the severity of the weathers conditions and the affected geographical areas within the mobile communication device on an ongoing basis.

Block 412 represents sending the notification of weather conditions to the communication device. If the conditions to the generation of notification conditions are satisfied, then the process flow may take Yes branch 414 to block 416 to send the notification of weather conditions to a primary number, such as the primary number 106. The notifications may be transmitted as a recording, a text-to-speech, a video, an instant message, an email, a text message, a voice mail message, or the like, depending on the communication device and the subscriber's profile 306. Block 412 may be repeated at any suitable interval to monitor the continued real-time locations of the mobile communication device.

From block 416, the process flow may proceed to block 418, if the subscriber's profile 306 indicates to send the notification of weather conditions to an identified number associated with the subscriber's identified list or a call list. Blocks 416 and 418 may be repeated in response to block 412, which monitors the continued real-time locations of the mobile communication device.

Additionally, distinctive ring functions or tones may accompany the transmission in blocks 416 and 418 to distinguish the notifications as an emergency or an urgent alert. These types of notifications may further include audible notifications, visual indications, vibrations and the like, depending on the communication devices and the subscriber's profile.

In exemplary embodiments, blocks 416 and 418 may represent providing instructions for simultaneous weather warnings to the primary number 106 of a first communication device and to an identified number, such as the identified number 107(*a*) of a second communication device. In an exemplary embodiment, a first communication device is a landline phone while the second communication device is a cellular phone. In exemplary embodiments, the communication devices may be the cellular phone as the first device and a computer as the second device.

Furthermore, blocks 416 and 418 may be transmitted over one or more networks, as the mobile communication device passes into the proximity of other networks. The process flow 400 may transmit the notification over a circuit-switched network and/or a packet-switched network.

Returning to block 412, if the conditions to the generation of notification conditions are not satisfied, then the process flow may take No branch 420 to block 422 to track the real-time location of the communication device. The tracking may continue depending on the affected geographical areas in relationship to the real-time location and the amount of time to track the one or more communication device. Block 420 may be repeated at any suitable interval to monitor the real-time locations of the mobile communication devices.

The application server 136 may be configured to receive weather information at periodic intervals. This periodic interval may be determined by the severity of the weather conditions, approaching conditions, dramatic weather changes, radar changes, and the like. By way of illustrations, the periodic intervals may be five minutes for a tornado warning, ten minutes for a thunderstorm watch, fifteen minutes for snow alerts, and the like. The periodic interval may be determined by the weather information service or the service provider. After the process reaches block 422, the process may start at block 402 again.

The subject matter described above may be implemented in hardware, or software, or in both hardware and software. Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claimed subject matter.

The invention claimed is:

1. A method comprising:

receiving weather conditions corresponding to an affected geographical area;

assessing a severity of the weather conditions;

accessing a database for information to determine notification conditions to be met to determine whether a notification is to be provided to each communication device of a plurality of communications devices of a subscriber, notification conditions comprising whether a communication device of the plurality of communications devices is to be notified, a number of communication devices of the plurality of communications devices to be notified, and a real-time location of each communication device of the plurality of communications devices;

identifying a location of each communication device of the plurality of communications devices in relationship to the affected geographical area, the identifying occurring subsequent to receiving the weather conditions within an amount of time based on the severity of the weather conditions;

generating a notification of weather conditions; and sending, the notification of weather conditions to each communications device of the plurality of communications devices for which respective conditions have been met, the notification of weather conditions being sent based on the determined communications device to be notified, the number of communications devices to be notified, the real-time location of each communications device to be notified, and a time of day at which the notification is sent.

2. The method of claim 1, wherein the communication device comprises at least one of a mobile device, a cellular phone, a Voice over internet protocol phone, a landline phone, a personal digital assistant, a pager, or a computer.

3. The method of claim 1, wherein the weather conditions are provided by a weather notification service that comprises at least one of a weather service, a weather station, a weather radio, a private weather information service, or an internal weather information service to a service provider.

4. The method of claim 1, wherein the affected geographical area comprises at least one of a nation, a region, a county, a city, a town, a phone number within a geographical area, a network address within a geographical area, or a zip code.

5. The method of claim 1, wherein the location of the communication device includes using at least one of a server, a global positioning system, a server-aided global positioning system, a position locating service, a triangulation method, a signal, or a cell tower.

6. The method of claim 1, wherein the database comprises at least one of the subscriber's name, the subscriber's phone number, the subscriber's network address, the subscriber's home address, the subscriber's work address, and the subscriber's services with a service provider.

7. The method of claim 1, wherein generating the notification of weather conditions comprises at least one of the subscriber's profile information, a real-time location, or a home address of the subscriber of the communication device.

8. The method of claim 1, wherein sending the notification further comprises sending at least one of a recording, a text message, a voice message, an instant message, a video, or an email.

9. The method of claim 1, wherein sending the notification further comprises sending at least one of distinctive ring functions, tones, audible notifications, vibrations, or visual indications.

10. The method of claim 1, wherein sending the notification comprises transmitting the notification of weather conditions over at least one of a circuit-switched network or a packet-switched network.

11. The method of claim 1, further comprising deleting a notification that has not been delivered after an amount of time has occurred.

12. An application server comprising:

a processor; and memory coupled to the processor, the memory comprising executable instructions that when executed by the processor cause the processor to effectuate operations comprising:

receiving indications of weather conditions corresponding to an affected geographical area;

accessing a severity of the weather conditions;

accessing a database for information relating to each communication device of a plurality of communications devices of a subscriber to determine notification conditions to be met to determine whether a notification is to be provided to a communication device of the plurality of communications devices, notification conditions comprising whether a communication device of the plurality of communications devices is to be notified, a number of communication devices to be notified, and a real-time location of each communication device of the plurality of communications devices, wherein the database contains profile information relating to subscriber associated with the plurality of communications devices;

identifying a respective location of each communication device of the plurality of communications devices, wherein identifying the respective location of each communication device occurs subsequent to receiving the indication of weather conditions within an amount of time based on the severity of the weather conditions;

evaluating the respective location of each communication device of the plurality of communications devices in relationship to the affected geographical area;

generating a notification of weather conditions based at least on the subscriber profile information in the database; and transmitting the notification of weather conditions to each communications device of the plurality of communications devices for which respective conditions have been met to at least one respective address for the each communication device as indicated in the profile information, the notification of weather conditions being transmitted, based on the determined communications device to be notified, the number of communications devices to be notified, the real-time location of each communications device to be notified, and a time of day at which the notification is sent.

13. The application server of claim 12, wherein the instructions to transmit the notification of weather conditions to an address comprise at least one of a network address or a phone number.

14. The application server of claim 12, wherein the instructions to transmit the notification of weather conditions to the communication device comprise instructions to transmit using at least one of a landline phone, a mobile device, a cellular phone, a Voice over internet protocol phone, a landline phone, a personal digital assistant, a pager, or a computer.

15. The application server of claim 12, wherein the instructions to transmit the notification of weather conditions to the communication device comprise instructions to transmit at least one of a recording, a text-to-speech, a video, an instant message, an email, a text message, a voice mail message, a distinctive ring function, a distinctive tone, an audible notification, a vibration, or a visual indication.

16. The application server of claim 12, wherein the instructions to transmit the notification of weather conditions to the communication device comprise instructions to transmit over at least one of a circuit-switched network or a packet-switched network.

17. The application server of claim 12, wherein the instructions to identify a location of the communication device comprise instructions to identify the location from at least one of a server, a global positioning system, a server-aided global positioning system, a triangulation, method, a position locating service, a signal, or a cell tower.

18. A computer-readable storage medium that is not a propagating signal, the computer-readable storage medium comprising instructions that when executed by a processor cause the processor to effectuate operations comprising:

receiving weather conditions corresponding to an affected geographical area;

assessing a severity of the weather conditions;

accessing a database for information to determine notification conditions to be met to determine whether a notification is to be provided to each communication device of a plurality of communications devices of a user, notification conditions comprising whether a communication device of the plurality of communications devices is to be notified, a number of communication devices of the plurality of communications devices to be notified, and a real-time location of each communication device of the plurality of communications devices;

identifying a location of each communication device of the plurality of communications devices in relationship to the affected geographical area;

generating a notification of weather conditions, the identifying occurring subsequent to receiving the weather conditions within an amount of time based on the severity of the weather conditions; and sending, the notification of weather conditions to each of the communications devices of the plurality of communications devices for which respective conditions have been met, the notification of weather conditions being sent based on the determined communications device to be notified, the number of communications devices to be notified, the real-time location of each communications device to be notified, and a time of day at which the notification is sent.

* * * * *